US006658801B2

(12) United States Patent
Kilduff et al.

(10) Patent No.: US 6,658,801 B2
(45) Date of Patent: Dec. 9, 2003

(54) PORTABLE FIRE CURTAIN SYSTEM

(76) Inventors: Patrick Kilduff, 86 Maryland Ave., Long Beach, NY (US) 11561; Thomas Oswald, 167 Fairfield Ave., Mineola, NY (US) 11501

( * ) Notice: Subject to any disclaimer, the term of this patent is extended or adjusted under 35 U.S.C. 154(b) by 38 days.

(21) Appl. No.: 09/898,100

(22) Filed: Jul. 3, 2001

(65) Prior Publication Data

US 2002/0046522 A1 Apr. 25, 2002

Related U.S. Application Data

(60) Provisional application No. 60/216,226, filed on Jul. 5, 2000.

(51) Int. Cl.[7] ..... E06B 9/06

(52) U.S. Cl. ..... 52/202; 52/63; 52/222; 52/317; 52/DIG. 12; 160/328; 160/354; 160/368.1

(58) Field of Search ..... 52/202, 222, 63, 52/317, DIG. 12; 160/327, 328, 354, 368.1

(56) References Cited

U.S. PATENT DOCUMENTS

| | | | | |
|---|---|---|---|---|
| 636,113 | A | | 10/1899 | Burger et al. |
| 2,305,468 | A | | 12/1942 | Ferrigno |
| 2,365,127 | A | | 12/1944 | Wagner |
| 2,738,040 | A | | 3/1956 | Waldin |
| 2,786,519 | A | | 3/1957 | Moore |
| 2,878,906 | A | | 3/1959 | Knebel |
| 2,887,154 | A | | 5/1959 | Morningstar et al. |
| 2,896,753 | A | | 7/1959 | Knebel |
| 3,762,110 | A | * | 10/1973 | Boss, Jr. ..... 52/222 |
| 3,862,876 | A | | 1/1975 | Graves |
| 3,946,789 | A | | 3/1976 | Ronkholz-Tolle, nee Tolle |
| 4,010,790 | A | | 3/1977 | Varga |
| 4,072,140 | A | | 2/1978 | Gallagher |
| 4,122,887 | A | | 10/1978 | Dussault et al. |
| 4,269,901 | A | | 5/1981 | Chamberlain |
| 4,691,753 | A | | 9/1987 | Baier |
| 4,791,994 | A | | 12/1988 | Ho |
| 4,836,265 | A | | 6/1989 | Bussert |
| 4,858,395 | A | * | 8/1989 | McQuirk ..... 135/903 |
| 5,265,662 | A | | 11/1993 | Hirao et al. |
| 5,271,449 | A | | 12/1993 | Herrick |
| 5,339,883 | A | | 8/1994 | Colson et al. |
| 5,829,200 | A | * | 11/1998 | Jones et al. ..... 52/3 |
| 5,966,877 | A | | 10/1999 | Hawes |

FOREIGN PATENT DOCUMENTS

| | | |
|---|---|---|
| WO | WO 98/09681 | 3/1988 |

* cited by examiner

*Primary Examiner*—Anita King
(74) *Attorney, Agent, or Firm*—Michael D. Fitzpatrick

(57) ABSTRACT

A portable fire curtain system to provide a cloak to cover a vented opening. When deployed it will alleviate the incoming wind, which is fueling the fire. The fire curtain is made of one sheet of a fire resistant or fire proof material that is folded and sewn together. Encapsulated within the fire curtain are 6 bars of high-tempered aluminum running laterally. Each corner of the fire curtain has holes that are drilled through the top and bottom bars. Four 5 foot cable leaders with loops, (one to each corner) will be secured to these holes. Two 40 foot ropes with snaps on all ends will be connected to these cable leaders to be used in the deployment. The ropes are packed in two rope deployment bags in order to prevent the ropes from tangling.

20 Claims, 8 Drawing Sheets

PORTABLE FIRE CURTAIN SYSTEM

1.0 RELATED APPLICATIONS

This application claims the benefit of U.S. Provisional Application No. 60/216,226 filed on Jul. 5, 2000, having the title Portable Fire Curtain.

2.0 BACKGROUND

A major problem in fighting fires is that wind blowing against a side of a building, enters any openings in the building such as open doorways and open windows, and thus fans the fire inside the building causing the fire to spread rapidly down the hallways of the building and into the rooms thereof. Such quickly spreading fires fanned by the wind blowing through the openings of a building have caused the deaths of many civilians and fire fighters. There is a great need for a portable fire fighting curtain which, when rolled up, could be conveniently carried by firemen, and could quickly and easily be used at the site of a fire to block building openings thus preventing the wind from blowing through building openings, and thus eliminating this cause of rapidly spreading fires within a building. The Applicants, after the deaths of some of their brother firefighters, decided that enough was enough; someone had to take the initiative and solve the problem of wind fueling fires.

3.0 SUMMARY

3.1 Opening

The instant invention is an improvement to fire curtains. The problem to be solved is the problem of wind fueling fires. Unfortunately, most of the background art devices are complicated, big and clumsy, or can not be easily adapted to solving this pressing problem. Applicants began making rough drafts of different curtain designs, but these were not to their liking. They were complicated, big, and clumsy. Realizing that this operation needed easy and quick deployment, packing that was simple, and a carrying case that was sleek and well balanced, Applicants brainstormed the idea and finally came up with a design that had all the attributes they wanted. Applicants are proud to introduce the Portable Fire Curtain System.

Applicants believe that the most significant distinguishing feature of the instant invention over all the background art devices is that the instant invention, being made of cloth, with encapsulated aluminum bars, is relatively light and easy to handle, and allows significantly faster deployment than the inventions in the background art, and can easily be moved from one window to another. Since time is of the essence in fighting fires, the instant invention includes two rope deployment bags which enable the ropes used to secure the fire curtain over a venting building opening to be quickly deployed without any risk of the ropes tangling.

It is, therefore, the main object of this invention to provide a portable fire curtain system which performs the task of blocking the winds which are fueling the fire, is relatively light and easy to handle, allows quick deployment, and can be easily moved from one window to another.

Applicants' portable fire curtain system possesses the following advantages:

- The instant invention, unlike most background art devices, is portable.
- The instant invention protects firefighters from the wind spreading flames when fighting fires in extreme wind conditions.
- The instant invention, having a fire curtain made of cloth, with encapsulated aluminum bars, is relatively light and easy to handle.

- The instant invention, by including upper and lower rope deployment bags, enables the fire curtain to be quickly secured to a venting building opening with virtually no possibility of the ropes tangling.
- The instant invention allows significantly faster deployment than the background art devices, and can easily be moved from one window to another.
- The instant invention is easy to use with most conventional windows.
- The instant invention is economical to manufacture and easy to pack and unpack.

3.2 Contents

The above features are objects of this invention. Yet further objects are as follows:

An object of the instant invention is to provide a portable fire curtain system which when used over a building opening is strong and sturdy, light weight, and easy to use.

A further object is to provide a portable fire curtain system that is economical in cost to manufacture.

A further object is to provide a portable fire curtain system which has a high level of strength and reliability.

Yet another object is to provide a portable fire curtain system which is still small enough and light enough to be easily stowed away and carried in a fire engine.

These and other objects, features, aspects, and advantages of the present invention will become better understood with regard to the following description, appended claims, and accompanying drawings and will be otherwise apparent to those skilled in the art.

For the purpose of illustration of this invention, a preferred embodiment is shown in the accompanying drawings. It is to be understood that this is for the purpose of example only and that the invention is not limited thereto.

4.0 BRIEF DESCRIPTION OF THE DRAWINGS

5.0 DESCRIPTION 5.1 Materials Used in Making the Invention

Fire Curtain

QUANTITY: 1

IS OMNI 45™ WHICH IS A BLEND OF BASOFIL®MELAMINE FIBERS AND PARA-ARAMID FIBERS

IS TWO PLY YARN AND RIPSTOP WEAVE CONSTRUCTION

IS A WEIGHT OF 8 oz./sq. yard.

Aluminum Bars

QUANTITY: 6

58½" LENGTH

2" WIDTH

¼" THICKNESS

HIGH TEMPERED 0.588 lb/ft

Cable Leaders

QUANTITY: 4

3/16" DIAMETER

5' LENGTH

Grommets

QUANTITY: 8

½" DIAMETER OPENING

BRASS

Cable Thimbles

QUANTITY: 4

¼" GUIDE

ALUMINUM

Ferrules

QUANTITY: 16 DOUBLE AND 16 SINGLE

HEAVY GAUGE ALUMINUM

¼" DIAMETER

Ropes

QUANTITY: 2

40 ' LENGTHS

½" DIAMETER

Snaps

SWIVEL EYE BOAT SNAPS

QUANTITY: 1

2" LENGTH

SWIVEL BOLT SNAPS

QUANTITY: 4

3" LENGTH

Thread

NOMEX™ (NOMEX is a trademark of E.I. DuPont de Nemours & Co.)

5.2 Detailed Description of the Elements 5.2.1 Introduction

The Portable Fire Curtain System is designed to provide a cloak to cover a building opening such as a window or door. When deployed it will block the incoming wind, which is fueling the fire.

5.2.2 Description of a Portable Fire Curtain System

The instant invention is a portable fire curtain system which is used to block a building opening of a burning building in order to prevent wind from blowing into that building opening and spreading flames in the burning building. The fire curtain included in the portable fire curtain system is affixed vertically to a building opening so as to block that building opening.

Figure 1:
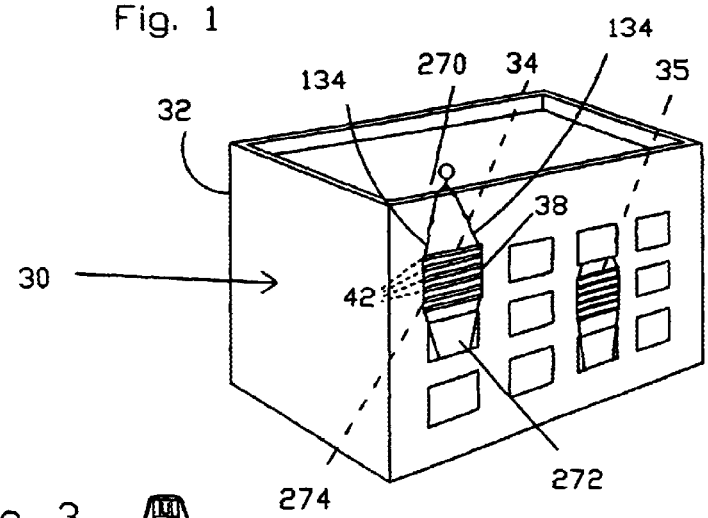
FIG. 1 shows a building with the portable fire curtain system installed over two windows it is desired to prevent from venting.
Figure 2:
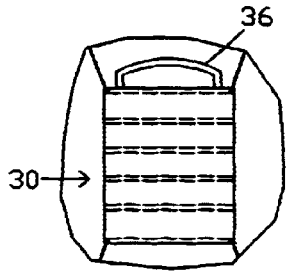
FIG. 2 shows a closeup elevation view of a portable fire curtain system in the process of being installed over a window it is desired to prevent from venting.
Figure 3:
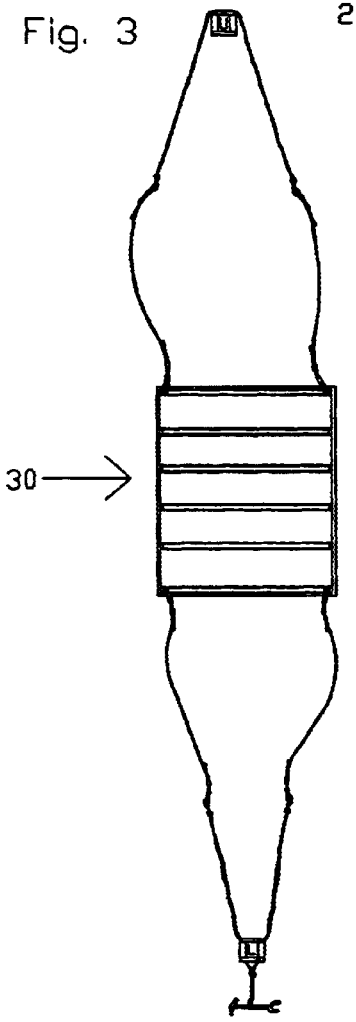
FIG. 3 shows the complete portable fire curtain system.
Figure 4:
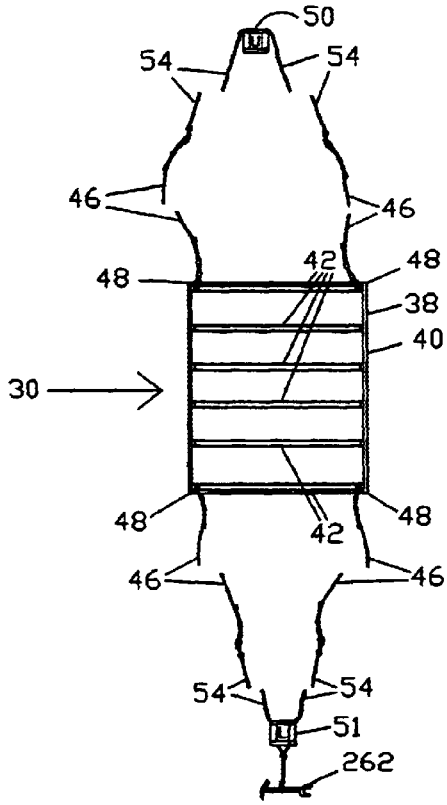
FIG. 4 shows the portable fire curtain system with parts of the bag connectors and curtain connectors broken away for greater visibility of detail.

Turning now descriptively to the drawings, in which similar reference characters denote similar elements throughout the several views, FIG. 1 shows a building 32 with the portable fire curtain system 30 installed over two windows 34, 35 it is desired to prevent from venting (the target windows 34, 35 or openings). FIG. 2 is a closeup elevation view of a portable fire curtain system 30 in the process of being installed over a window 36 it is desired to prevent from venting. As best seen in FIG. 3 which shows the complete portable fire curtain system 30, and FIG. 4, which shows the portable fire curtain system 30 with parts of the bag connectors and curtain connectors broken away for greater visibility of detail, the portable fire curtain system 30 consists of:

- a fire curtain 38 which is an elongated substantially rectangular piece of fire resistant fabric material 40
- a plurality of spaced stiffeners 42 encapsulated into this fire curtain 38. These stiffeners can be either bars or tubing. For ease of reference, the term "bar" shall be used for "stiffener" throughout the rest of this description.
- curtain connectors 46 attached to each of the four corners 48, 48, 48, 48 of this fire curtain 38. These curtain connectors can be either cable leaders or fireproof ropes. For ease of reference, the term "cable" or "cable leaders" shall be used for "curtain connector" throughout the rest of this description.
- two bag connector deployment bags 50, 51, each bag connector deployment bag containing two bag connector sections 54 for attaching the bag connector deployment bags 50, 51 to the cables 46 extending from the corners 48, 48, 48, 48 of the fire curtain 38. These bag connectors can be either ropes or straps. For ease of reference, the term "rope" shall be used for "bag connector", and "rope deployment bag" shall be used for "bag connector deployment bag" throughout the rest of this description.

Figure 5:
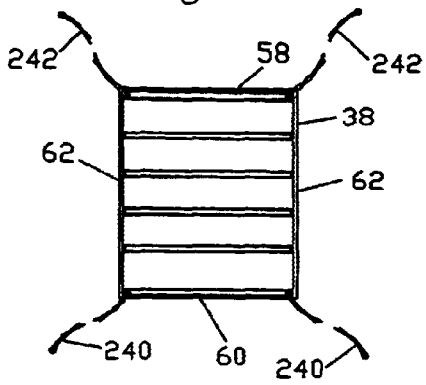
FIG. 5 shows a fire curtain after stiffeners have been inserted and the cables have been attached.

As shown in FIG. 5, the fire curtain 38 has a top edge 58 and a bottom edge 60 which are shorter than the two side edges 62. Preferably, the fire curtain 38 is made of Basofil and Kevlar weave.

This material is made by NOR.FAB Corporation. Their trade name for this material is "OMNI 45™" FIREFIGHTER Outer SHELL FABRIC". This fabric is a woven light weight dimensionally stable fabric blend of Para-Aramid and BASOFIL® fibers. The fiber make-up is 40% Basofil® and 60% Para-Aramid. (BASOFIL® is a registered trademark of BASF Corporation and Para-Aramid and Kevlar are trademarks of DuPont Company. The 'design' of "OMNI 45" is an optimal blend of Basofil fiber combined with strong Para-aramid fibers. The two ply yarn and Ripstop weave construction is engineered into "OMNI 45™".

Aramid Fiber has the following characteristics:

No melting point

Low flammability

Good fabric integrity at elevated temperatures

Aramid is spun as a multifilament by a proprietary process developed by DuPont Company.

Para-aramid fibers, which have a slightly different molecular structure than aramid fiber, also provide outstanding strength-to-weight properties, high tenacity and high modulus.

NOR.FAB Corporation's "OMNI 45"™ FIREFIGHTER Outer SHELL FABRIC utilizes KEVLAR® brand para-aramid fiber in its composition. Fibers of KEVLAR® consist of long molecular chains produced from poly-paraphenylene terephthalamide. The chains are highly oriented with strong interchain bonding which result in a unique combination of properties.

General Features:

High Tensile Strength at Low Weight

Low Elongation to Break

High Modulus (Structural Rigidity)

Low Electrical Conductivity

High Chemical Resistance

Low Thermal Shrinkage

High Toughness (Work-To-Break)

Excellent Dimensional Stability

High Cut Resistance

Flame Resistant, Self-Extinguishing

Figure 7:
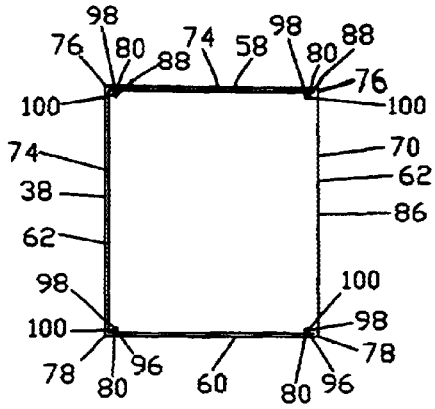
FIG. 7 shows the two sections of the fire curtain folded and sewn together along the upper and lower edges and along one of the side edges; also shown are the grommets reinforcing the holes at each of the four corners of the fire curtain.
Figure 6:
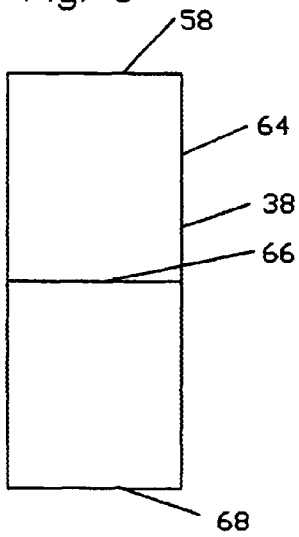
FIG. 6 shows a front view of the fire curtain before it was folded and sewn together.

As shown in FIGS. 6 and 7, the rectangular piece of fire resistant material 64 which is being used to make the fire curtain 38 is folded upon itself at the horizontal dashed lines 66 in the center of the material so that the bottom edge 68 of the material is even with and rests on the top edge 58. As shown in FIG. 7, the two sections of this folded piece of material 70 are then sewn together along the upper edge 58, the lower edge 60, and along one of the side edges 62 of this folded piece of material 70. Preferably, the two sections of this folded piece of material 70 are sewn together with a fire resistant thread 74. This thus folded and thus sewn piece of material is hereinafter referred to as the fire curtain 38. Two holes 80, 80 are cut in the upper two corners 76, 76 and the lower two corners 78, 78 of the fire curtain. The holes 80, 80, in the upper two corners 76, 76 are located approximately 1½ inches from the top edge 58 and approximately 2 inches from the side edge 62 nearest to that corner. These holes 80 pass completely through the fire curtain material 86 from the front side to the backside of this folded piece of material 70. The two holes 80, 80 cut in the upper two corners 76, 76 are designated the upper two curtain holes 88, 88. Similarly, holes 80, 80 cut in the lower two corners 78, 78 of this folded piece of material 70 are located approximately 1½ inches from the lower edge 60 and approximately two inches from the side edge 62 nearest to that corner. These two holes 80, 80 are designated the lower two curtain holes 96. Each of the upper two curtain holes 88 and the lower two curtain holes 96 extend from the front side to the back side of the fire curtain 38. Preferably, the rims 98 of the upper two curtain holes 88 and the rims 98 of the lower two curtain holes 96 of the fire curtain 38 are reinforced and strengthened with grommets 100, 100, 100, 100. (A grommet is a reinforced eyelet through which a fastener may be passed.) Thus each curtain hole will be reinforced with two grommets—one on the front side of the fire curtain 38 and one on the backside of the fire curtain 38.

Figure 8:
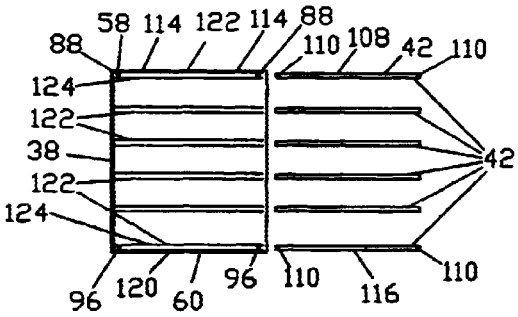
FIG. 8 shows the fire curtain with the stiffeners in position for inserting them into the pockets of the fire curtain.
Figure 9:
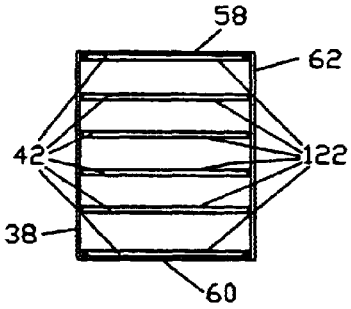
FIG. 9 shows the fire curtain just after inserting six spaced stiffeners into pockets of the fire curtain.

As shown in FIGS. 8 (before) and 9 (after), a plurality of spaced bars 42, preferably six in number, is encapsulated, preferably by stitching, into the fire curtain 38 for providing stiffness to the fire curtain 38 in order to prevent a wind from blowing the fire curtain 38 into the window which it is covering. Preferably a series of six equidistantly spaced elongated laterally running pockets 122 for the reception of these bars 42 with the pockets longest edge 124 parallel to the upper and lower edges 58, 60 of the fire curtain 38 are stitched into the fire curtain 38. These pockets 122 hold the six spaced bars 42 running laterally. Preferably, these spaced bars 42 are substantially parallel to and equidistant from one another. Preferably, these bars 42 are made of high tempered aluminum. The uppermost bar 108 has a bar hole 110 near each end which lines up with the corresponding upper two curtain holes 88 in the fire curtain 38 after this bar 108 has been slid into the uppermost pocket 114. Likewise the lowermost bar 116 has a bar hole 110 near each end which lines up with the corresponding lower two curtain holes 96 in the fire curtain 38 after this bar 116 has been slid into the lowermost pocket 120. Thus, after these six spaced bars 42 are placed in their respective pockets 122, they are substantially parallel to the upper and lower edges 58, 60 of the fire curtain 38. FIG. 9 shows the fire curtain 38 after the bars 42 have been inserted into their respective pockets 122 and the side 62 of the fire curtain having the open pockets, has been stitched to secure the bars 42 in the pockets 122.

Figure 10:
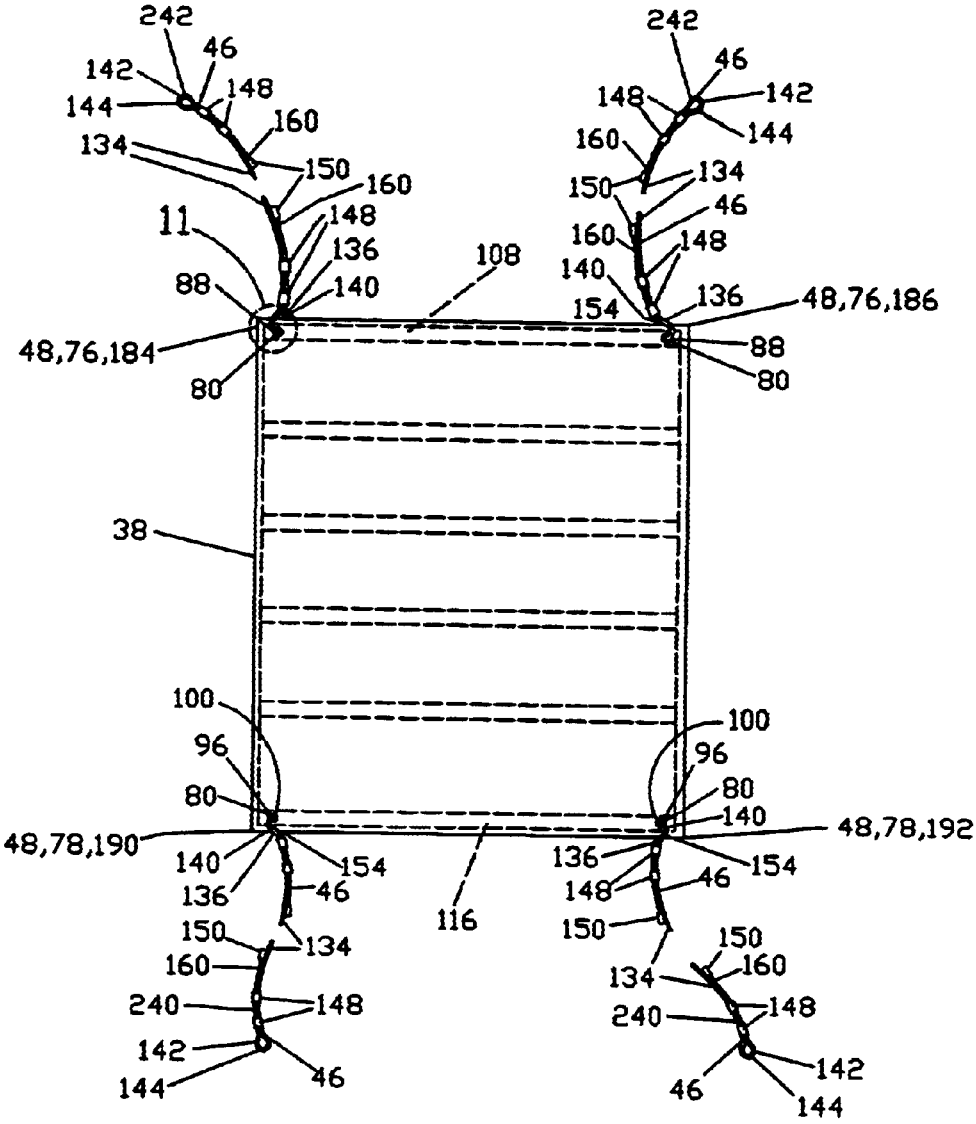
FIG. 10 shows the fire curtain with a four foot cable leader attached to each of the four holes at the corners of the fire curtain with the central sections of the cables broken away for greater visibility of detail; also shown are the ferrules used to form the loops and prevent fraying of the ends of the cable leaders.

As shown in FIG. 10, attached to each of the four holes 88, 88, 96, 96 at the corners 48 of the fire curtain 38 is a four foot cable leader 134 (the central sections of the cables have been broken away in FIG. 10 for greater visibility of detail). Each of these cable leaders 134 has a first end 136 having means 140 for attaching it to a curtain hole at one of the corners 48 of the fire curtain 38 and a second end 142 having a loop 144. Preferably after the loop 144 at the second end 142 of the cable leader is formed, a double ferrule 148 is used to secure that loop 144, and a single ferrule 150 is used to inhibit fraying of the cable end 160.

Figure 11:
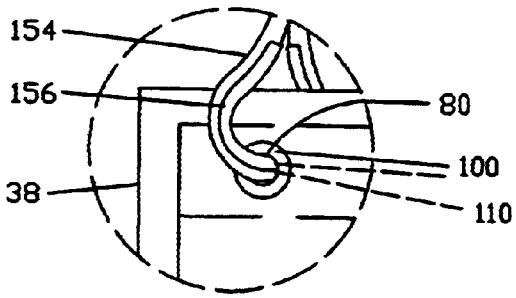
FIG. 11 shows an enlarged view of the contents of dashed circle 11 in FIG. 10.

The means for attaching the cable leaders 134 to the curtain holes 80 in the corners 48 of the fire curtain 38 can be clips, loops, or snaps. Applicants' preferred means for attaching the cable leaders 134 to the holes 80 in the fire curtain 38 is loops 154. The loops 154 pass through the grommets 100 on the front side of the fire curtain 38, through the bar holes 110 of the encapsulated uppermost and lowermost bars 42, and then through the grommets 100 on the back side of the fire curtain 38. As shown in FIG. 11 which is an enlarged view of the contents of dashed circle 11 in FIG. 10, where loops 154 are used for this purpose, a cable thimble 156 is used to prevent chafing of the cable loop 154 on the fire curtain 38 at its grommets 100. Preferably, after the loop 154 is formed, a double ferrule 148 is placed on the cable leader to secure that loop 154 and a single ferrule 150 is used to inhibit fraying of the cable end 160.

As shown in FIGS. 4, 10, 12–15, the portable fire curtain system 30 further consists of two rope deployment bags, an upper rope deployment bag 50 and a lower rope deployment bag 51. The upper rope deployment bag 50 has a 40 foot rope 164 secured at its midpoint to the inside bottom 166 of the upper rope deployment bag 50 such that the two free ends 168, 168 of this rope 164 can be connected to the loops 144 at the ends of the cables 46 extending from the upper two corners 76 of the fire curtain 38. The ropes 164 for connecting the rope deployment bags 50, 51 to the loops 144 at the ends of the cables 46 can be either ropes or straps. For ease of reference, the term "rope" shall be used for "bag connector" and the term "rope deployment bag" shall be used for "bag connector deployment bag" throughout the rest of this specification.

Alternatively, a single 50 foot piece of flexible fire proof rope can be used in place of the cable leaders and rope.

Either clips or snaps can be used to attach the two free ends 168, 168 of the rope 164 from the upper rope deployment bag 50 to the cable leaders 134 attached to the upper two corners 76 of the fire curtain 38. It is preferred, however, to connect swivel bolt snaps 178 to each of the two free ends 168, 168 of the rope 164. These swivel bolt snaps 178 are then used to connect one free end 168 of the rope 164 to the loop 144 at the end 142 of the cable leader 134 extending from the upper left corner 184 of the fire curtain 38, and the other free end 168 of the rope 164 to the loop 144 at the end 142 of the cable leader 134 extending from the upper right corner 186 of the fire curtain 38.

Similarly, as shown in FIGS. 4, 10, 16–19, the lower rope deployment bag 51 has a rope 164 secured at its midpoint to the inside bottom 166 of the lower rope deployment bag 51 such that the two free ends 168, 168 of this rope 164 can be connected to the loops 144 at the ends of the cable leaders 46 extending from the lower two corners 78 of the fire curtain 38. Again, either clips or snaps can be used to attach the two free ends 168, 168 of the rope 164 from the lower rope deployment bag 51 to the cable leaders 134 attached to the lower two corners 78 of the fire curtain 38. It is preferred, however, to connect swivel bolt snaps 178 to each of the two free ends 168, 168 of the rope 164. These swivel bolt snaps 178 are then used to connect one free end 168 of the rope 164 to the loop 144 at the end 142 of the cable leader extending from the lower left corner 190 of the fire curtain 38, and the other free end 168 of the rope 164 to the loop 144 at the end 142 of the cable leader 134 extending from the lower right corner 192 of the fire curtain 38.

Figure 12:
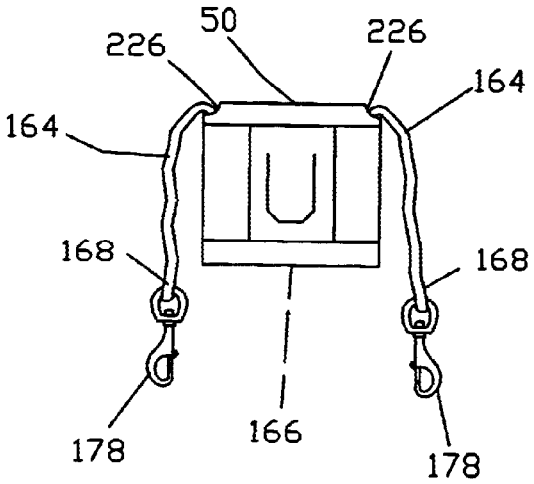
FIG. 12 shows a front view of the upper rope deployment bag.
Figure 16:
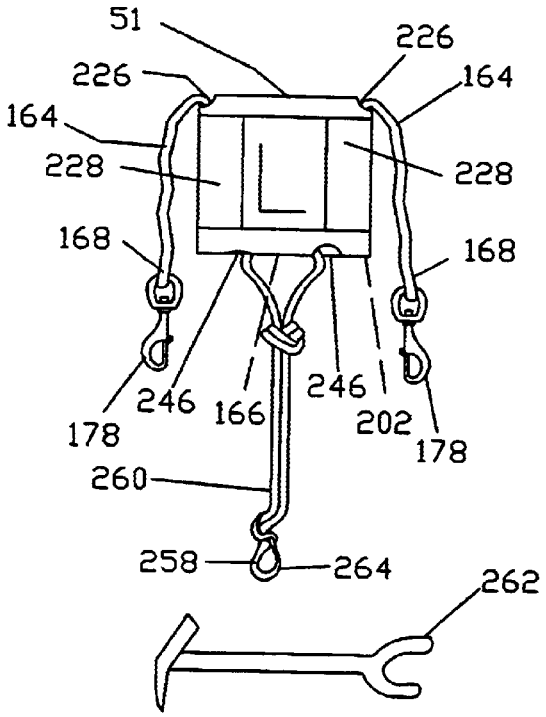
FIG. 16 shows a front view of the lower rope deployment bag.
Figure 20A:
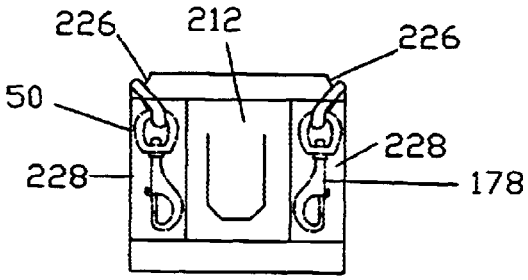
FIG. 20A shows the swivel bolt snaps of the upper rope deployment bag inserted in their bolt snap pockets.
Figure 20B:
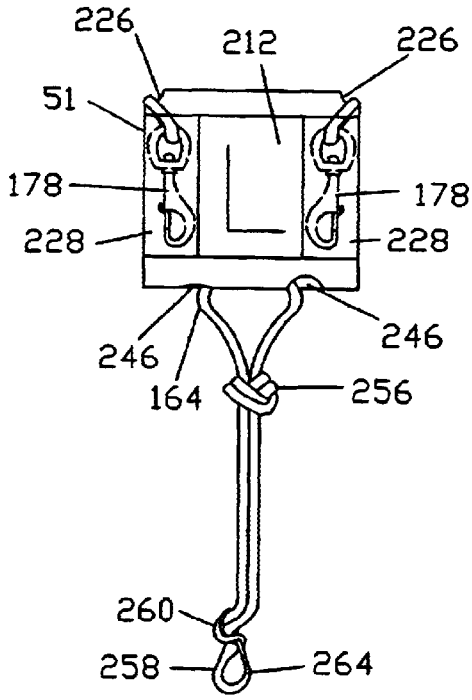
FIG. 20B shows the swivel bolt snaps of the lower rope deployment bag inserted in their bolt snap pockets.

Preferably, as shown in FIGS. 13, 14, 17, 18, each of the fire rope deployment bags 50, 51 has a central divider or partition 194 which separate the bag into two rope pockets 196, 197. This central divider 194 preferably runs parallel to the lip 198 of the rope deployment bag 50, 51 and has its top edge 172 near the mouth 200 of the rope deployment bag, and a bottom edge 174 which is joined, preferably by sewing, to the inside bottom 202 of the rope deployment bag 50, 51. The bottom 204 of this central divider 194 has a hole or cutout 206 therein through which the rope 164 passes. As previously mentioned the midpoint of each rope 164 is sewn to the inside bottoms 202 of each rope deployment bag 50, 51. Thus in the rope's stored state, half of the rope 164 will reside in one rope pocket 196 and the other half of the rope 164 will reside in the other rope pocket 197 thus keeping the rope halves separate and eliminating any possibility of the ropes becoming tangled with each other. Each rope deployment bag 50, 51 has a flap 212 with a strip of hook and loop fastener material 214 fastened on its inside surface 216. A mating piece of hook and loop fastener material 218 is fastened to the lower front portion 220 of the exterior of each rope deployment bag 50, 51. Thus for each rope deployment bag 50, 51, the rope deployment bag's flap 212 can be folded over and its attached strip of hook and loop fastener material 214 can be joined to the mating piece of hook and loop fastener material 218 on the lower portion 220 of the exterior of the rope deployment bag 50, 51, thus securing the rope deployment bag 50, 51 in its closed state. Preferably in its closed state each rope deployment bag 50, 51 will have a small rope hole 226 at each end of the bag at the approximate height of the top 172 of the divider 194 which divides the rope deployment bag 50, 51 into two pockets 196, 197. Preferably, as shown in FIGS. 12, 16, when the flap 212 is in its closed state, on its outside front are two smaller bolt snap pockets 228 open at the top. To get each rope deployment bag 50, 51 ready for eventual use, the swivel bolt snap 178 attached to the end of the rope 164 in one rope pocket 196, 197 is pulled though one of these rope holes 226 along with the end of the rope 164 to which it is attached. Then the swivel bolt, snap 178 is placed in the bolt snap pocket 228 closest to the rope hole 226 from which it was withdrawn. Likewise the swivel bolt snap 178 attached to the end of the rope 164 in the other rope pocket is pulled through the other rope hole 226 along with the end of the rope 164 to which it is attached. Then this swivel bolt snap 178 is placed in the bolt snap pocket 228 closest to the rope hole 226 from which it was withdrawn. FIGS. 20A and 20B show the swivel bolt snaps 178 of the upper and lower rope deployment bags inserted in their respective bolt snap pockets 228, 228. Then in the event of a fire, one merely need pull one of the swivel bolt snaps 178 from its bolt snap pocket 228 and pull on it thus withdrawing one half section of rope 164 from the rope deployment bag 50, 51 without having to open the rope deployment bag's flap 212 (which would risk the two rope sections becoming tangled). Likewise, one would pull the other swivel bolt snap 178 from its bolt snap pocket 228 and pull on it thus withdrawing its half section of rope 164 from the rope deployment bag 50, 51 without having to open the rope deployment bag's flap 212 (which again would risk the two rope sections becoming tangled). Thus one can quickly withdraw both sections of rope 164 without any risk of them becoming tangled with each other.

Figure 15:
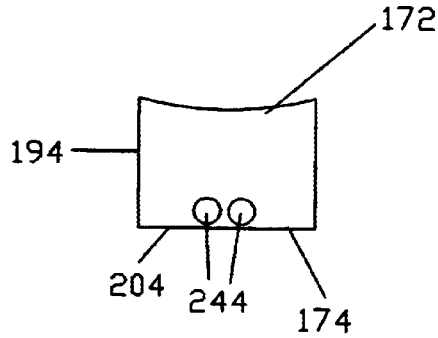
FIG. 15 shows the front view of an alternate embodiment of the central divider of the upper rope deployment bag.

Alternatively and preferably, as shown in FIG. 15, instead of sewing the middle of the rope 164 to the bottom 166 of the upper rope deployment bag 50, the central divider 194 in the upper bag can have two holes 244, 244 therethrough near its bottom edge 174. Then the rope 164 can be passed through these two holes 244, 244 and knotted around the portion of the central divider 194 between these two holes 244, 244, thus providing a more secure fastening than sewing would provide.

Likewise, alternatively and preferably, instead of sewing the middle of the rope 164 to the bottom 166 of the lower rope deployment bag 51, the central divider 194 can have two holes 244, 244 therethrough near its bottom edge 174. The rope 164 is then knotted around the portion of the central divider 194 between the two holes 244 in the divider thus providing a more secure fastening than sewing provides. Most preferably, the lower rope deployment bag 51 then will have two holes 246 in its bottom, one on each side of where the central divider 194 is joined to the inside bottom 202 of the lower rope deployment bag 51. Thus one of these holes 246 is in the first rope pocket 196 and the other hole 246 is in the second rope pocket 197. A portion of the rope 164 near its middle is then made to protrude out of these two holes 246 in the bottom of the lower rope deployment bag 51 and is knotted 256 at the point where the rope 164 protrudes through the two holes 246 in the bottom of the lower rope deployment bag 51. Then a snap 258 is attached to this portion 260 of the protruding rope 164 in order that a weight 262 can be attached thereto. Most preferably, this snap 258 is a swivel eye boat snap 264.

Figure 21:
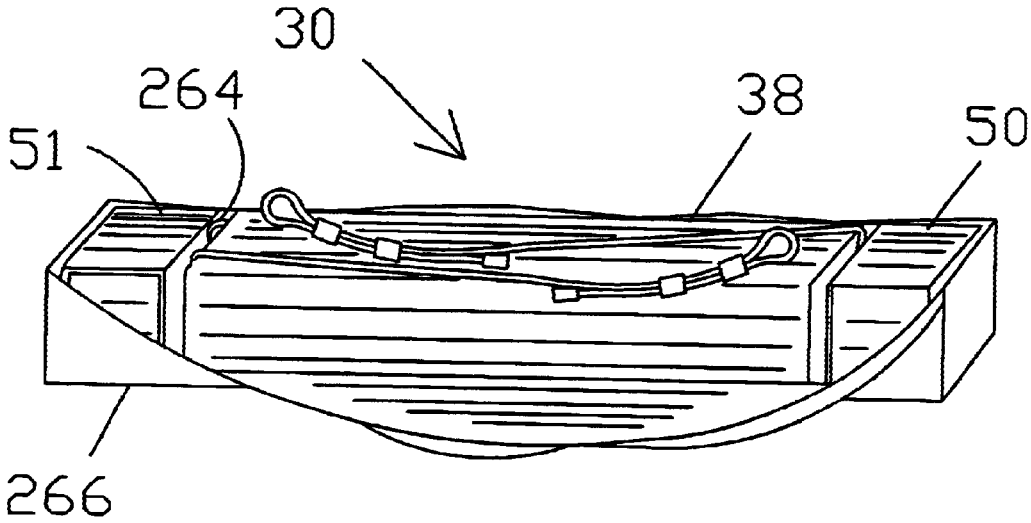
FIG. 21 shows the tote bag to be used for carrying the portable fire curtain system with its flap open.

Preferably, a suitably sized tote bag 266 is used for carrying the portable fire curtain system 30 as is shown diagrammatically in FIGS. 21 (open) and 22 (closed). This tote or carry bag is similar to a ski tote.

A portable fire curtain system 30 being used to cover a window 36 is shown in FIG. 1.

It should be noted that:

1. The rigid bars 42 sewn into the fire curtain 38 are preventing the wind from blowing the fire curtain 38 into the window 34.
2. The bars 42 also work with each other to weight the fire curtain 38, each bar 42 pulling on the bars above it.
3. The bars 42 are equidistantly spaced.
4. Cable leaders 134 prevent the possible burning of the ropes (if ropes alone were used instead of cable leaders) should the fire start to vent.
5. One window or elevation above 270 and below 272 the target opening 274 is needed for this operation.
6. Should the fire curtain 38 have been deployed over the wrong window, the fire curtain 38 is easily passed to another window while still outside the building 32.
7. The fire curtain 38 can be lowered and redeployed quickly and effectively.

Figure 13:
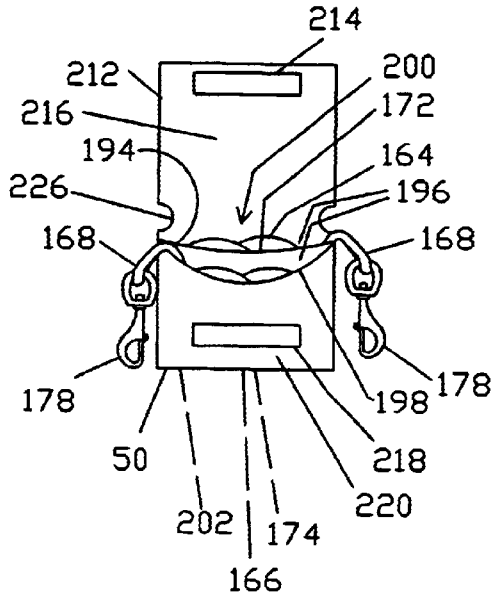
FIG. 13 shows a front view of the upper rope deployment bag with its flap open.
Figure 14:
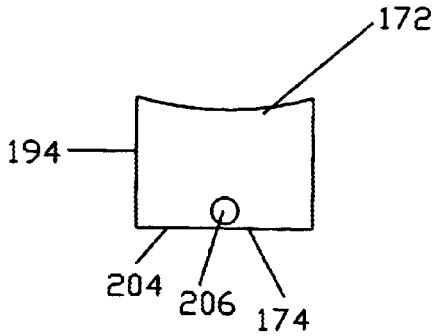
FIG. 14 shows a front view of the central divider of the upper rope deployment bag.
Figure 17:
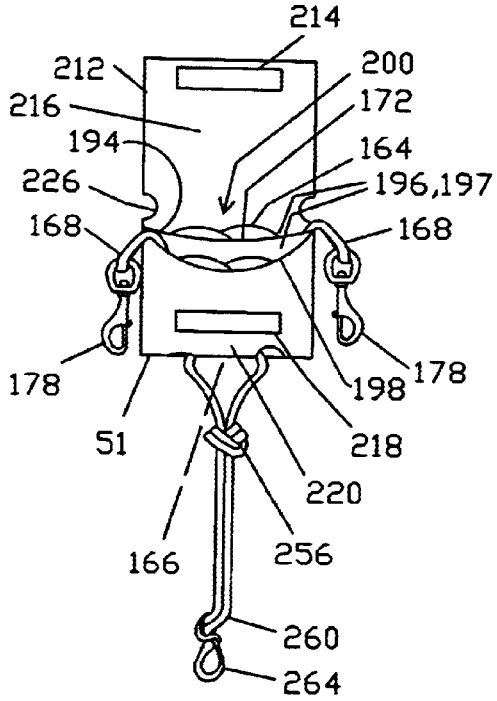
FIG. 17 shows a front view of the lower rope deployment bag with its flap open.
Figure 18:
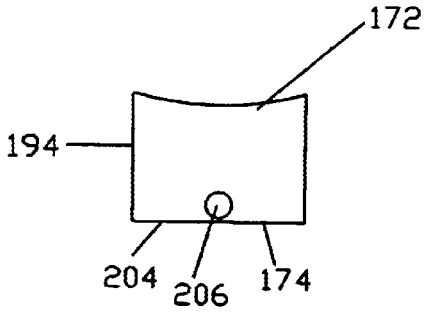
FIG. 18 shows a front view of the central divider of the lower rope deployment bag.
Figure 19:
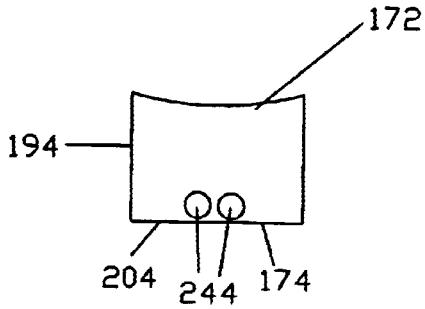
FIG. 19 shows the front view of an alternate embodiment of the central divider of the lower rope deployment bag.

Packing of the rope 164 in the rope deployment bags 50, 51 is shown in FIGS. 13 and 17.

1. One continuous 40' length of rope 164.
2. Its mid-section is secured to the bottom of the rope deployment bag 50, 51.
3. Each rope pocket has a 20' section packed within.
4. Snaps are attached to each end.

The cable leaders 134 are shown in FIGS. 10, 11.

1. A cable leader 134 is attached to each corner 76, 78 of the fire curtain 38 through the bar holes 110 in the top and bottom bars 108, 116. (Alternatively, fire resistant rope could be used in place of cable leaders 134.) The loops 154 of the cable leaders 134 have cable thimbles 156 which prevent the cable leaders 134 from chafing at the attachment points to the fire curtain 38 (the holes 80 reinforced with grommets 100). (A cable thimble 156 is a tubular sleeve or channel which has been shaped to conform to and cover the inner surface of a loop which has been formed of cable thus serving as a guide for the portion of the cable leader forming the loop.)
2. The cable leaders 134 are ¼" in diameter.
3. The cable leaders 134 are 5' in length.
4. Ferrules 148, 150 are used to form and secure loops 144, 154 and prevent fraying.

METHOD OF ROLLING THE FIRE CURTAIN PRIOR TO PACKING FOR DEPLYYMENT

The following steps can be followed to roll the fire curtain 38 prior to packing for deployment:

(a) Lay the fire curtain 38 on a level surface.

(b) Take one of the lower cables attached to the bottom corner of the fire curtain 38 and place it over the opposite bottom corner of the fire curtain 38, so that the loop 144 thereof extends just beyond the edge of the fire curtain 38.

(c) Take the cable leader attached to the other bottom corner of the fire curtain 38 and place it over the first bottom corner of the fire curtain 38, so that the loop 144 thereof extends just beyond the edge of the fire curtain 83.

(d) Roll the fire curtain 38 from bottom to top so that the cables 46 are rolled up within the roll of the curtain.

(e) Place the fire curtain 38 within the tote bag 266, and lay the top cables across the length of the fire curtain 38, so that when the tote bag 266 is opened, the cables will not be tangled with each other.

METHOD OF DEPLOYING THR PORTABLE FIRE CURTAIN SYSTEM TO COVER A TARGET OPENING

Figure 22:
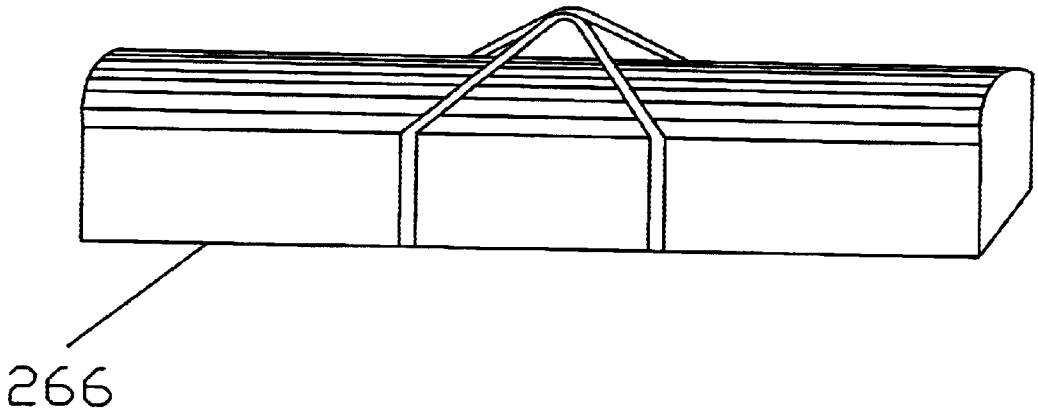
FIG. 22 shows the tote bag to be used for carrying the portable fire curtain system with its flap closed.

The following steps show the method of deploying the portable fire curtain system 30 to cover a target opening 274 (Please refer to FIG. 1):

(a) Take the tote bag 266 (FIG. 22) containing the portable fire curtain system 30 to an elevation 270 above the target opening 274.

(b) Remove the fire curtain 38 and the upper and lower rope deployment bags 50, 51 from the tote bag 266 (FIG. 21).

(c) Attach the ropes of the lower rope deployment bag 51 of the portable fire curtain system 30 to the second end loops 144 of the lower set of cable leaders 240 that are protruding from the ends of the rolled up fire curtain 38.

(d) Attach a weight 262 (FIG. 16) to the snap 258 attached to the tail of rope 260 protruding from the bottom of the lower rope deployment bag 51.

(e) Attach the upper rope deployment bag ropes 168 to the second end loops 144 of the upper set of cable leaders 242.

(f) Drop the lower rope deployment bag 51 to an elevation 272 that is lower than the target opening 274.

(g) Secure the ropes from the lower rope deployment bag 51 at the lower elevation 272.

(h) Secure the ropes from the upper rope deployment bag 50 at the upper elevation 270.

(i) Place the fire curtain 38 outside the upper elevation 270, and allow the fire curtain 38 to unroll.

(j) Take up the slack in the ropes at the lower elevation 272, thus maintaining tension in the ropes.

(k) Lower the fire curtain 38 to cover the target opening 274.

(l) Maintain continued tension on all four ropes.

(m) Maintain the position of the fire curtain 38 until the fire has been extinguished.

Packing of the rolled fire curtain 38, the lower rope deployment bag 51 (on the left) and the upper rope deployment bag 50 (on the right) is shown in FIG. 21.

1. The lower rope deployment bag 51 on the left shows a small portion of the snap 264 that a weight can be attached to; this weight will assist in the lowering of the lower rope deployment bag 51 to the elevation 272 below the target window 274 or opening.
2. Each length of rope 164 deploys snag free from holes 226 in the upper corners of the rope deployment bags 50, 51.

5.3 Specifications

1. The fire curtain is made of OMNI 45™, which is a blend of Basofil®Melamine and Para-Aramid fibers.

2. The weight of the finished product in its carrying bag is approximately 28 lbs.

3. All sewing is done with Nomex™ thread.

The fire curtain starts with a rectangular sheet that is 5'½"×12'½".

5. The edges of the sheet are hemmed at ½".

The sheet is folded onto itself to the rectangular dimension of 5'×6'.

7. One side edge is sewn together.

8. The bottom edge is sewn together.

9. The fire curtain has 6 bars running parallel to and equidistant from each other.

10. The bars are made of high tempered aluminum, with dimensions of 2"×¼"×58½".

11. One bar is located at the top of the fire curtain and another bar is located at the bottom of the fire curtain, and the remaining four bars are equidistantly spaced within the fire curtain.

12. Pockets are sewn for each bar through the material of the fire curtain.

13. The top bar pocket has stitching along the bottom through the material and the top edge uses the fold of the material to form the pocket.

14. The bottom bar pocket has stitching along the top through the material and the bottom edge uses the stitching from Step 8 to form the pocket.

15. The four interior bars have pockets by stitching through the material at the top and bottom edges of the bars.

16. The top and bottom bars have ½" holes drilled through them towards the ends.

17. In line with these ½" holes on the rectangular sheet of the fire curtain itself, ½" grommets are placed on both faces of the sheet toward all four corners.

18. The bars are slid into the pockets.

19. The remaining edge of the fire curtain sheet (edge number 4) is then sewn together to enclose the bars.

20. The loop of a cable leader along with a cable thimble (which serves as a guide or channel for the portion of cable leader forming the loop) is passed through each set of grommets and each ½" hole in the aluminum bars in each corner.

21. Two double ferrules are used to secure the cables together forming a loop, and single ferrules are placed before and after these sets.

22. The remaining ends of the four cable leaders, which are not secured to the fire curtain, have loops with double ferrules and single ferrule secured to them in the same afore-mentioned manner.

23. Two ropes, ½" in diameter and 40' in length, have swivel bolt snaps attached to both ends.

24. One rope is for the top and the other is for the bottom of the fire curtain.

25. The mid-point of the bottom rope has a swivel eye boat snap attached to it. This will facilitate the attaching of a weighted tool to the rope.

26. The ends of the ropes are clipped to the ends of the cable leaders on the top and bottom of the fire curtain.

5.4 Packing

1. The fire curtain is placed on the ground and the bottom cable leaders are placed from corner to corner horizontally across the bottom bar.

2. The fire curtain is then rolled continuously from bottom to top. When rolled, the bottom cable leaders' looped ends are protruding outside of the sides of the rolled fire curtain 3. The top cable leaders are placed horizontally from edge to edge of the rolled fire curtain.

4. The ropes are packed in rope deployment bags that have separate pockets in them to avoid entanglement.

5. The mid-points of the ropes are secured to the bottom of the rope deployment bags and each length is placed in a separate pocket. The rope deployment bag that has the bottom rope in it has a tail of rope dangling from the bottom of the rope deployment bag with the swivel eye boat snap on the end of it.

6. The flap of the rope deployment bag is closed and the ends of the ropes that have the snaps on them are placed at the two opposite sides of the rope deployment bag.

7. The rolled curtain is placed in the tote bag and the two rope deployment bags are placed in the tote bag at opposite ends.

5.5 Deployment

1. The portable fire curtain system is designed to provide a cover or wind block to a window or opening in a building or structure where wind is fueling the fire through the window or opening.

2. The tote bag containing the portable fire curtain system is carried to an elevation that is higher than the window or opening it is desired to block (the target window or opening).

3. The fire curtain is removed from the tote bag.

4. Remove upper and lower rope deployment bags from the tote bag.

5. The lower rope deployment bag which contains the bottom rope, has a tail on its bottom with a hinged snap attached to it. A weighted object is then secured to that snap.

6. The snaps on the ends of the bottom rope are clipped onto the loops at the second ends of the cable leaders that are protruding from the sides of the rolled-up fire curtain.

7. The weighted object is lowered via the rope to an elevation that is lower than the target window or opening.

8. The weighted object and the rope are then gathered at an elevation lower than the target opening.

9. The upper rope deployment bag which contains the top rope is placed next to the fire curtain.

10. The snaps at the ends of the top rope are clipped onto the loops at the second ends of the two remaining cable leaders.

11. The fire curtain is then deployed from the higher elevation via the top ropes to cover the target window or opening below it.

12. The fire curtain will unroll from top to bottom until it is fully open.

13. The lower ropes are then gathered in to produce tension to secure the fire curtain in place.

14. The fire curtain is placed so that it covers the target window or opening.

15. When there is a wind, the force of the wind causes the four exterior edges of the fire curtain to be in contact with that portion of the structure which surrounds the target window or opening thus creating a seal.

16. The bars of the fire curtain maintain the integrity of the shape of the fire curtain, not allowing the fire curtain to be pushed or sucked into the opening, and this aids in the adherence of the seal.
17. This seal is accomplished due to the rigidity and weight of each bar, and the force of the wind.
18. The wire leaders, being non-burning material, enable the fire curtain to stay in place.
19. The fire curtain has completed the task that it was intended to do because this seal has disrupted the wind that was fueling the fire.

Figure 23:
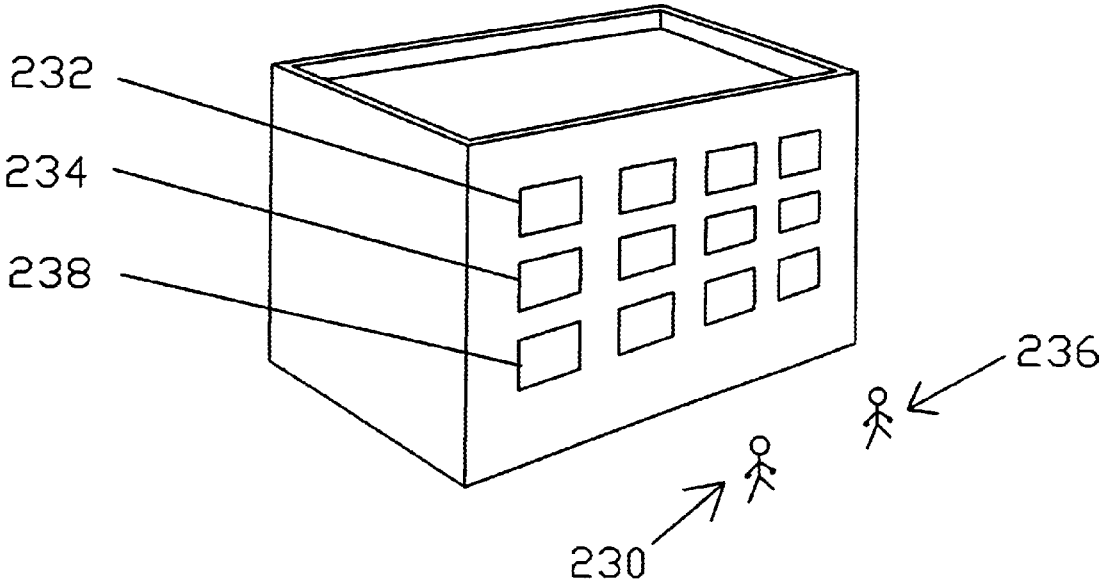
FIG. 23 shows the manner of using the portable fire curtain system.

FIG. 23 shows the manner of using the portable fire curtain system.

Reference number 230 shows a fireman who is to go to an elevation (window 232) above the target window 234. Reference number 234 is the target window which is to be covered with the fire curtain. Reference number 236 shows a fireman who is to go to an elevation (window 238) below the target window 234.

The portable fire curtain system would be deployed as follows:

1. Fireman 230 carries the carrying case with its enclosed fire curtain and two rope deployment bags to elevation 232.
2. Fireman 230 removes the fire curtain, the lower rope deployment bag and the upper rope deployment bag from the carrying case.
3. Fireman 230 attaches a weighted object to the snap hanging from the lower rope deployment bag.
4. Fireman 230 attaches the snaps of the lower rope deployment bag to the loops at the ends of the cables from the lower corners of the fire curtain.
5. Fireman 230 attaches the snaps of the upper rope deployment bag to the loops at the ends of the cables from the upper corners of the fire curtain.
6. Fireman 230 lowers the lower rope deployment bag and the weighted object from the elevation 232 above the target window 234 to Fireman 236 at the elevation 238 below the target window 234 via the lower ropes.
7. Fireman 236 gathers the lower rope deployment bag, the weighted object and the lower ropes at the elevation 238 below the target window 234.
8. Fireman 230 lowers the fire curtain from elevation 232 via the upper ropes thus covering the target window 234.
9. Fireman 236 administers tension on the lower ropes.
10. The fire curtain is positioned to cover the target window 234 thus obstructing the wind.

5.6 Advantages of the Invention

The portable fire curtain system has advantages of efficiency, reasonable weight, and ease of use.

The instant invention, unlike most background art devices, is portable.

The instant invention protects firefighters and civilians from the wind spreading flames when fighting fires in extreme wind conditions.

The instant invention, being made of cloth, with encapsulated aluminum bars, is relatively light and easy to handle.

The instant invention allows significantly faster deployment than the background art devices, and can easily be moved from one window to another.

The instant invention is easy to use with most conventional windows.

The instant invention is economical to manufacture and easy to pack and unpack.

5.6 List of Reference Numbers

30 portable fire curtain system
32 building
34 window #1
35 window #2
36 window
38 fire curtain
40 rectangular piece of fire resistant fabric material
42 stiffener (either a bar or tubing)
46 curtain connector (either a cable leader or a rope)
48 a corner of the fire curtain
50 upper bag connector deployment bag
51 lower bag connector deployment bag
54 bag connector sections
58 top or upper edge of fire curtain
60 bottom edge of fire curtain
62 side edge of fire curtain
64 rectangular piece of fire resistant material
66 horizontal dashed lines indicating where curtain material is to be folded
68 bottom edge of the material
70 folded piece of material
72 hole in central divider
74 fire resistant thread
76 an upper corner of fire curtain
78 a lower corner of fire curtain
80 hole in corner of fire curtain
86 fire curtain material
88 hole in upper corner of fire curtain
90 lower folded edge
96 hole in lower corner of fire curtain
98 rims of curtain holes
100 grommets
102 curtain hole
108 uppermost stiffener (bar or tubing)
110 stiffener (bar or tubing) holes
114 uppermost curtain pocket
116 lowermost stiffener (bar or tubing)
120 lowermost curtain pocket
122 pocket for the reception of a stiffener (bar or tubing)
124 longest edge of pocket
128 six spaced stiffeners (bars or tubing)
134 four foot curtain connector (cable leader or rope)
136 first end of curtain connector (cable leader or rope)
140 means for attaching curtain connector (cable leader or rope) to a curtain hole
142 second end of curtain connector (cable leader or rope)
144 loop at second end of curtain connector (for attaching to snap at end of bag connector)
148 double ferrule
150 single ferrule
154 loop at cable leader's first end for attaching cable leader to hole in fire curtain
156 cable thimble
158 cable loop

160 cable end
164 40 foot bag connector (rope or strap)
166 inside bottom of a bag connector (rope or strap) rope deployment bag
168 free end of bag connector (rope or strap)
172 top edge of central divider
174 bottom edge of central divider
178 swivel bolt snap
184 upper left corner of the fire curtain
186 upper right corner of the fire curtain
190 lower left corner of the fire curtain
192 lower right corner of the fire curtain
194 central divider or partition
196 rope pocket #1
197 rope pocket #2
198 lip of the rope deployment bag
200 mouth of the rope deployment bag
202 inside bottom of the rope deployment bag
204 bottom of this central divider
206 hole in central divider
212 flap of rope deployment bag
214 strip of hook and loop fastener material
216 inside surface of flap of rope deployment bag
218 mating piece of hook and loop fastener material
220 lower front portion of the exterior of the rope deployment bag
226 small rope hole for dispensing rope at upper end of rope deployment bag
228 bolt snap pocket
230 fireman who is to go to an elevation above the target window
232 elevation above the target window
234 the target window to be covered with the fire curtain
236 fireman who is to go to an elevation below the target window
238 elevation below the target window
240 lower set of curtain connectors
242 upper set of curtain connectors
244 hole in central divider
246 holes in bottom of lower rope deployment bag
252 portion of the rope near its middle
256 knot in rope protruding from lower rope deployment bag
258 snap attached to portion of rope protruding from lower rope deployment bag
260 portion of the protruding rope
262 weight
264 swivel eye boat snap
266 tote bag
270 window or elevation above the target opening
272 window or elevation below the target opening
274 target opening It will be understood that each of the elements described above, or two or more together may also find a useful application in other types of devices and methods differing from those types described above.

5.7 Alternatives and the Closing

Thus the reader will see that my portable fire curtain system supplies a long felt need for a simple, economical, easy to use portable fire curtain system. Although the present invention has been described in considerable detail with reference to certain preferred versions thereof, other versions are possible which will be apparent to those who are skilled in the art. While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Therefore, the spirit and scope of the appended claims should not be limited to the description of the preferred versions contained herein, but by the appended claims and their legal equivalents.

We claim:

1. A portable fire curtain system for affixing vertically to a building opening so as to block the building opening, said portable fire curtain system comprising:

(a) a fire curtain comprising a substantially rectangular piece of material, said rectangular piece of material when positioned vertically having an upper edge, a lower edge, two side edges, a front side, and a back side, said piece of material thus having two upper corners and two lower corners, each of said two upper corners having a hole located a predetermined distance therefrom, said holes being designated the upper two holes, each of said lower two corners having a hole located a predetermined distance therefrom, said holes being designated the lower two holes, each of said upper two holes and said lower two holes extending from the front side to the backside of said piece of material;

(b) a plurality of spaced stiffeners selected from the group consisting of bars and tubing, said spaced stiffeners being encapsulated into said fire curtain for providing stiffness to said fire curtain, wherein one stiffener designated the uppermost stiffener has holes near the ends thereof corresponding to the upper two holes in the fire curtain, and one stiffener designated the lowermost stiffener has holes near the ends thereof corresponding to the lower two holes in the fire curtain;

(c) an upper set of curtain connectors selected from the group consisting of cable leaders and ropes, each of said curtain connectors having a first end having means for attaching to the fire curtain and a second end having a loop, each of said curtain connectors being attached their first ends to each of the two upper corners of said fire curtain at their holes;

(d) a lower set of curtain connectors selected from the group consisting of cable leaders and ropes, each of said curtain connectors having a first end having means for attaching to the fire curtain and a second end having a loop, each of said curtain connectors being attached at their first ends to each of the two lower corners of said fire curtain at their holes;

(e) an upper bag connector deployment bag having a mouth and a bottom, said upper bag connector deployment bag having a bag connector therein, said bag connector having a first end and a second end, said bag connector being secured near its middle to the bottom of said bag connector deployment bag, said first end and said second end of bag connector having means for attaching to the loops at the second ends of said curtain connectors attached to said upper corners of said fire curtain; and (f) a lower bag connector deployment bag having a mouth and a bottom, said lower bag connector deployment bag having a bag connector therein, said bag connector having a first end and a second end, said bag connector being secured near its middle to the bottom of said bag connector deployment bag, said first end and said second end of bag connector having means for attaching to the loops at the second ends of said curtain connectors attached to said lower corners of said fire curtain.

2. The portable fire curtain system of claim 1 wherein the bag connector is a rope and the lower bag connector deployment bag is a lower rope deployment bag, said lower rope deployment bag having a hole in the bottom thereof and a portion of said rope near its middle protrudes out of said hole, said portion of said protruding rope having a snap attached thereto for attaching a weight thereto.

3. The portable fire curtain system of claim 1 wherein said fire curtain is one elongated sheet of material which is folded and sewn together.

4. The portable fire curtain system of claim 3 wherein the fire curtain is sewn together with a fire resistant thread.

5. The portable fire curtain system of claim 3 wherein the fire curtain is made of Basofil and Kevlar weave.

6. The portable fire curtain system of claim 1 wherein said plurality of spaced stiffeners are substantially parallel to the upper and lower edges of said fire curtain.

7. The portable fire curtain system of claim 1 wherein said bag connector is rope, and:

(a) said upper bag connector deployment bag is an upper rope deployment bag, said upper rope deployment bag having a central divider which separates the upper rope deployment bag into two pockets, said central divider having a top edge near the mouth of said upper rope deployment bag, and a bottom edge joined to the bottom of said upper rope deployment bag;

(b) the rope is secured in the upper rope deployment bag such that substantially half its length resides in the first pocket and the other half its length resides in the second pocket, whereby tangling of the two half sections of rope is minimized;

(c) said lower bag connector deployment bag is a lower rope deployment bag, said lower rope deployment bag having a central divider which separates the lower rope deployment bag into two pockets, said central divider having a top edge near the mouth of said lower rope deployment bag, and a bottom edge joined to the bottom of said lower rope deployment bag;

(d) the lower rope deployment bag has a hole in the bottom thereof and a portion of said rope near its middle protrudes out of said hole, said portion of said protruding rope having a snap attached thereto for attaching a weight thereto, and said rope is secured in the lower rope deployment bag such that substantially half its length resides in the first pocket and the other half its length resides in the second pocket, whereby tangling of the two half sections of rope is minimized.

8. The portable fire curtain system of claim 7, wherein:

(a) the central divider in the upper rope deployment bag has two holes therethrough near its bottom edge, and the rope passes through the two holes and is knotted around the portion of the central divider between the two holes;

(b) the lower rope deployment bag has two holes in the bottom thereof, one hole being in the first pocket and the other hole being in the second pocket;

(c) the central divider in the lower rope deployment bag has a top edge near the mouth of said lower rope deployment bag, and a bottom edge joined to the bottom of said lower rope deployment bag, said central divider having two holes therethrough near its bottom edge, said rope being knotted around the portion of the central divider between the two holes in said divider, and being knotted at the point where said rope protrudes through the two holes in the bottom of the lower rope deployment bag.

9. The portable fire curtain system of claim 1, wherein the plurality of spaced stiffeners are high tempered aluminum bars.

10. The portable fire curtain system of claim 1 wherein the curtain connectors are cables, the bag connectors are ropes and:

(a) said means for attaching the cables to the fire curtain is selected from the group consisting of clips, loops, and snaps; and (b) said means for attaching first and second ends of the rope to a cable leader is selected from the group consisting of clips and snaps.

11. The portable fire curtain system of claim 1 wherein the upper two holes and the lower two holes in the fire curtain are reinforced with grommets.

12. The portable fire curtain system of claim 1 further comprising a tote bag for carrying said portable fire curtain system.

13. The portable fire curtain system of claim 1 wherein the curtain connectors are cables, and:

(a) the loop at the second end of each of said cables further comprises:

(i) a double ferrule to form and secure that loop, and (ii) a single ferrule to inhibit fraying of the cable end; and (b) the loop at the first end of each of said cables further comprises:

(i) a cable thimble to prevent chafing of the cable loop on the rectangular piece of material at its grommet, and (ii) a double ferrule to form and secure that loop, and (iii) a single ferrule to inhibit fraying of the cable end.

14. The portable fire curtain system of claim 1 wherein the plurality of spaced stiffeners are substantially parallel to and equidistant from one another.

15. A portable fire curtain system for affixing vertically to a building opening so as to block the building opening, said portable fire curtain system comprising:

(a) a fire curtain comprising a substantially rectangular elongated sheet of fire resistant material which is folded and sewn together, said elongated sheet of fire resistant material when positioned vertically having an upper edge, a lower edge, two side edges, a front side, and a back side, said piece of material thus having two upper corners and two lower corners, each of said two upper corners having a hole located a predetermined distance therefrom, said holes being desighated the upper two holes, each of said lower two corners having a hole located a predetermined distance therefrom, said holes being designated the lower two holes, each of said upper two holes and said lower two holes extending from the front side to the backside of said piece of material;

(b) a plurality of spaced high tempered aluminum bars encapsulated into said fire curtain for providing stiffness to said fire curtain, wherein one aluminum bar designated the uppermost bar has holes near the ends thereof corresponding to the upper two holes in the fire curtain, and one bar designated the lowermost bar has holes near the ends thereof corresponding to the lower two holes in the fire curtain, said bars being substantially parallel to the upper and lower edges of said fire curtain, and being substantially parallel to one another;

(c) an upper set of curtain connectors, each of said curtain connectors having a first end having a loop and a second end having a loop, each of said curtain connectors being attached at their first ends to each of the two upper corners of said fire curtain at their holes;

(d) a lower set of curtain connectors, each of said curtain connectors having a first end having a loop and a second end having a loop, each of said curtain connectors being attached at their first ends to each of the two lower corners of said fire curtain at the holes in the corners;

(e) an upper rope deployment bag comprising a rope having a first end and a second end, said rope being secured at its middle to the inside of said rope deployment bag, said first end and said second end having snaps attached to each end thereof for attaching to the loops of said curtain connectors attached to said upper corners of said, fire curtain; and (f) a lower rope deployment bag having a hole in the bottom thereof, said lower rope deployment bag having a rope having a first end and a second end, said rope being secured at its middle to the inside of said rope deployment bag, a portion of said rope protruding out of said hole, said first end and said second end having a snap attached to each end thereof for attaching to the loops at the second ends of the lower set of curtain connectors, and (g) a snap attached to the portion of said rope protruding out of the hole in the bottom of the lower rope deployment bag, whereby a weight can be attached to the bottom rope deployment bag.

16. The portable fire curtain system of claim 15 wherein:

(a) the upper rope deployment bag has a central divider which separates the upper rope deployment bag into two pockets, said central divider having a top, a bottom, and a height;

(b) the rope is secured in the upper rope deployment bag such that substantially half its length resides in the first pocket and the other half its length resides in the second pocket, whereby tangling of the two half sections of rope with each other is minimized;

(c) the lower rope deployment bag has a central divider which separates the lower rope deployment bag into two pockets, said central divider having a top, a bottom, and a height;

(d) the rope is secured in the lower rope deployment bag such that substantially half its length resides in the first pocket and the other half its length resides in the second pocket, whereby tangling of the two hat sections of rope with each other is minimized.

17. The portable fire curtain system of claim 16 wherein each rope deployment bag has a small rope hole at the upper corner of each end of the bag at the approximate height of the top of said central divider.

18. The portable fire curtain system of claim 16 further comprising a flap having an outside front surface, said flap being joined to each rope deployment bag, wherein said flap has two bolt snap pockets on its outside front surface.

19. A method of rolling a portable fire curtain system, said fire curtain system comprising:

(a) a fire curtain having a top edge having two corners, a bottom edge having two corners, the distance between the two top corners defining the length of the curtain after it has been rolled up, and two side edges;

(b) an upper pair of cables, one of said cables being attached at one end to one of the top two corners of the fire curtain, the other of said cables being attached at one end to the other of the top two corners of the fire curtain, the other end of each of said cables being unattached to the fire curtain, each of said cables having a loop at its unattached end;

(c) a lower pair of cables, one of said cables being attached at one end to one of the bottom two corners of the fire curtain, the other of said cables being attached at one end to the other of the bottom two corners of the fire curtain, the other end of each of said cables being unattached to the fire curtain, each of said cables having a loop at its unattached end; and (d) a tote bag for holding the rolled fire curtain system;

said method comprising the steps of:

(a) laying the fire curtain on a level surface;

(b) taking one of the lower cables attached to the bottom corner of the fire curtain and placing it over the opposite bottom corner of the fire curtain, so that the loop thereof extends just beyond the side edge of the fire curtain;

(c) taking the cable leader attached to the other bottom corner of the fire curtain and placing it over the first bottom corner of the fire curtain, so that the loop thereof extends just beyond the side edge of the fire curtain; and (d) rolling the fire curtain from bottom to top so that the above said cables are rolled up within the roll of the fire curtain;

(e) placing the fire curtain within the tote bag; and (f) laying the upper pair of cables along the length of the rolled-up fire curtain, so that when the tote bag is opened the cables will not be tangled with each other.

20. A method of deploying a portable fire curtain system to cover a target opening, said portable fire curtain system being of the type which comprises:

(a) a fire curtain having a top edge having two corners, a bottom edge having two corners, the distance between the two top corners defining the length of the curtain after it has been rolled up, and two side edges, said two side edges defining the two ends of the curtain after it has been rolled up;

(b) an upper pair of cables, one of said cables being attached at one end to one of the top two corners of the fire curtain, the other of said cables being attached at one end to the other of the top two corners of the fire curtain, the other end of each of said cables being unattached to the fire curtain, each of said cables having a loop at its unattached end;

(c) a lower pair of cables, one of said cables being attached at one end to one of the bottom two corners of the fire curtain, the other of said cables being attached at one end to the other of the bottom two corners of the fire curtain, the other end of each of said cables being unattached to the fire curtain, each of said cables having a loop at its unattached end, said fire curtain initially being rolled up such that the ends of the lower set of cable leaders protrude from the two ends of the rolled up fire curtain;

(d) an upper rope deployment bag comprising a rope having a first end and a second end, said rope being secured at its middle to the inside of said rope deployment bag, said first end and said second end having snaps attached to each end thereof for attaching to the loops of said pair of cables attached to said upper corners of said fire curtain; and (e) a lower rope deployment bag having a hole in the bottom thereof, said lower rope deployment bag having a rope having a first end arid a second end, said rope being secured at its middle to the inside of said rope deployment bag, portion of said rope protruding out of said hole, said first end and said second end having a snap attached to each end thereof for attaching to the loops at the second ends of the lower pair of cables, and (f) a snap attached to the portion of said rope protruding out of the hole in the bottom of the lower rope deployment bag, whereby a weight can be attached to the bottom rope deployment bag;

said method comprising the steps of:

(a) taking the portable fire curtain system to an elevation above the target opening;

(b) attaching the ends of the rope of the lower rope deployment bag of the portable fire curtain system to the second end loops of the lower set of cable leaders that are protruding from the ends of the rolled up fire curtain;

(c) attaching a weight to the snap attached to the portion of rope protruding from the hole in the bottom of the lower rope deployment bag:

(d) attaching the ends of the rope of the upper rope deployment bag to the second end loops of the upper set of cable leaders;

(e) dropping the lower rope deployment bag to an elevation that is lower than the target opening;

(f) securing the ropes from the lower rope deployment bag at the lower elevation;

(g) securing the ropes from the upper rope deployment bag at the upper elevation;

(h) placing the rolled-up fire curtain outside the upper elevation, and allowing the fire curtain to unroll; (i) taking up the slack in the ropes at the lower elevation, thus maintaining tension in said ropes;

(j) lowering the fire curtain to cover the target opening;

(k) maintaining continued tension on all four ropes; and (l) maintaining the position of the fire curtain until the fire has been extinguished.

* * * * *